US007819575B2

(12) United States Patent
Li

(10) Patent No.: US 7,819,575 B2
(45) Date of Patent: Oct. 26, 2010

(54) TWINKLE LIGHT BULB APPARATUS

(75) Inventor: Zhaoyuan Li, Kowloon Bay (HK)

(73) Assignee: Cindex Holdings Limited, Kowloon Bay (HK)

( * ) Notice: Subject to any disclaimer, the term of this patent is extended or adjusted under 35 U.S.C. 154(b) by 0 days.

(21) Appl. No.: 11/838,471

(22) Filed: Aug. 14, 2007

(65) Prior Publication Data

US 2009/0046481 A1 Feb. 19, 2009

(51) Int. Cl.
*F21V 21/00* (2006.01)

(52) U.S. Cl. ..... 362/653; 362/654; 362/655; 362/640; 362/252; 362/647

(58) Field of Classification Search ..... 362/252, 362/249, 391, 647, 653–655, 640, 249.01, 362/249.16
See application file for complete search history.

(56) References Cited

U.S. PATENT DOCUMENTS

| | | | | |
|---|---|---|---|---|
| 6,376,974 | B1 * | 4/2002 | Tsai | 313/318.01 |
| 6,474,841 | B1 * | 11/2002 | Rahman | 362/252 |
| 6,799,867 | B1 * | 10/2004 | Cheng | 362/249 |
| 6,806,656 | B2 * | 10/2004 | Rahman | 315/185 R |
| 7,029,161 | B1 * | 4/2006 | Lin | 362/654 |
| 7,063,452 | B2 * | 6/2006 | Kuo | 362/653 |
| 2005/0286255 | A1 * | 12/2005 | Sugar | 362/391 |

FOREIGN PATENT DOCUMENTS

| | | |
|---|---|---|
| CN | 2356598 | 1/2000 |
| CN | 2610804 | 4/2004 |
| CN | 2643776 | 9/2004 |
| CN | 2662742 | 12/2004 |
| CN | 2713285 | 7/2005 |
| CN | 2715644 | 8/2005 |
| CN | 2844672 | 12/2006 |
| CN | 2859802 | 1/2007 |
| CN | 2859869 | 1/2007 |
| CN | 2877090 | 3/2007 |

(Continued)

OTHER PUBLICATIONS

Office Action issued in Chinese Patent Application No. 200710182139.2, English translation, mailed Jul. 31, 2009, 7 pages.

*Primary Examiner*—Anabel M Ton
(74) *Attorney, Agent, or Firm*—Dorsey & Whitney LLP

(57) ABSTRACT

A twinkle light bulb set with improved safety mechanism is provided. The twinkle light bulb set includes a plurality of twinkle light bulb apparatuses and steady burning light bulb apparatuses. Each twinkle light bulb apparatus includes a twinkle light bulb socket and a twinkle light socket holder, the twinkle light bulb socket being removably retained in and electrically coupled with the twinkle light bulb socket holder. Each steady burning light bulb apparatus includes a steady burning light bulb socket and a steady burning light socket holder, the steady burning light bulb socket being removably retained in and electrically coupled with the steady burning light bulb socket holder. The twinkle light bulb socket can be replaced by either a replacement twinkle light bulb socket or a replacement steady burning light bulb socket, and the steady burning light bulb socket can only be replaced by a replacement steady burning light bulb socket and cannot be replaced by a replacement twinkle light bulb socket.

6 Claims, 8 Drawing Sheets

FOREIGN PATENT DOCUMENTS

| | | |
|---|---|---|
| CN | 2888257 | 4/2007 |
| CN | 1987196 | 6/2007 |
| CN | 201039025 | 3/2008 |
| CN | 200730007406.3 | 3/2008 |
| CN | 201066054 | 5/2008 |
| CN | 2859802 | 1/2009 |

* cited by examiner

TWINKLE LIGHT BULB APPARATUS

CROSS-REFERENCE TO RELATED APPLICATION(S)

None.

FIELD OF THE INVENTION

The present invention relates to a twinkle light bulb apparatus. More particularly, the present invention relates to a twinkle light bulb apparatus with an improved safety mechanism.

BACKGROUND OF THE INVENTION

Twinkle lights have been widely used for holiday season decoration. A twinkle light set generally includes a plurality of steady burning light bulbs blended with a plurality of twinkle light bulbs connected therebetween. According to the safety requirements under UL Standard 588, more than half of the light bulbs in a twinkle light set need to be steady burning light bulbs or not flashing, so as to prevent accidental fire and/or other related hazards.

Sometimes, during the use of the twinkle light set, one or more twinkle light bulbs or steady burning light bulbs are burned out, and yet more than often, a user accidentally replaces a burned-out steady burning light bulb with a replacement twinkle light bulb as opposed to a replacement steady burning light bulb. Such accidental replacement may cause violation of UL Standard 588, and even worse, may cause fire and/or other related hazards.

It is, therefore, desirable, if not critical, to have an improved twinkle light bulb apparatus with a safety mechanism.

SUMMARY OF THE INVENTION

The present invention provides an improved twinkle light bulb apparatus with a safety mechanism, such that a steady burning bulb can only be replaced by a steady burning bulb, in other words, a standard burning bulb cannot be replaced by a twinkle light bulb, thereby preventing accidental fire and/or other related hazards. It is also desirable that a burned-out twinkle light bulb can be replaced by either another twinkle light bulb or a steady burning bulb if a user so choose, for instance, when a user has no replacement twinkle light bulb left but still wants to maintain a decorative lighting condition by using a replacement steady burning light bulb instead.

In one embodiment of the present invention, a twinkle light bulb set includes a plurality of twinkle light bulb apparatuses and a plurality of steady burning light bulb apparatuses wherein each twinkle light bulb apparatus includes a twinkle light bulb socket with a twinkle light bulb securely retained therein and a twinkle bulb socket holder. The twinkle light bulb socket is removably retained in and electrically coupled with the twinkle light bulb socket holder. The twinkle light bulb socket holder includes a keyway clearance for receiving a projected member disposed on an outside wall of the twinkle light bulb socket. A replacement twinkle light bulb socket or a replacement steady burning light bulb socket can be retained within and electrically coupled to the twinkle light bulb socket holder.

Further in one embodiment of the present invention, each steady burning light bulb apparatus includes a steady burning light bulb socket with a steady light bulb securely retained therein and a steady burning bulb socket holder. The steady burning light bulb socket is removably retained in and electrically coupled with the steady light bulb socket holder. Only a replacement steady burning light bulb socket can be retained within and electrically coupled to the steady burning light bulb socket holder. A replacement twinkle light bulb socket cannot be electrically coupled to the steady burning light bulb socket holder. In one embodiment, the projected member disposed on the outside wall of a replacement twinkle light bulb socket prevents the replacement twinkle light bulb socket from being fully inserted into, retained within, and electrically coupled to, the steady burning light bulb socket holder. Still in one embodiment of the present invention, the projected member disposed on the outside wall of a replacement twinkle light bulb socket is a male member, and the twinkle light bulb socket holder includes a female member having the keyway clearance for receiving the male member.

Yet in an alternative embodiment of the present invention, the projected member disposed on the outside wall of a replacement twinkle light bulb socket is a male member, and the twinkle light bulb socket holder includes the keyway clearance formed between the inside wall of the twinkle light bulb socket holder and the outside wall of the twinkle light bulb socket for retaining the male member disposed on the outside wall of the replacement twinkle light bulb socket. The steady light bulb socket holder does not include a keyway clearance so that the replacement twinkle light bulb socket with the male member is stopped from being inserted into, retained therein, and electrically coupled to the steady light bulb socket holder.

These and other advantages of the present invention will become apparent to those skilled in the art from the following detailed description, wherein it is shown and described illustrative embodiments of the invention, including best modes contemplated for carrying out the invention. As it will be realized, the invention is capable of modifications in various obvious aspects, all without departing from the spirit and scope of the present invention. Accordingly, the drawings and detailed description are to be regarded as illustrative in nature and not restrictive.

BRIEF DESCRIPTION OF THE DRAWINGS

The drawings, which are part of the present invention, illustrate the preferred embodiments of the present invention.

DETAILED DESCRIPTION OF THE PREFERRED EMBODIMENTS

Figure 14:
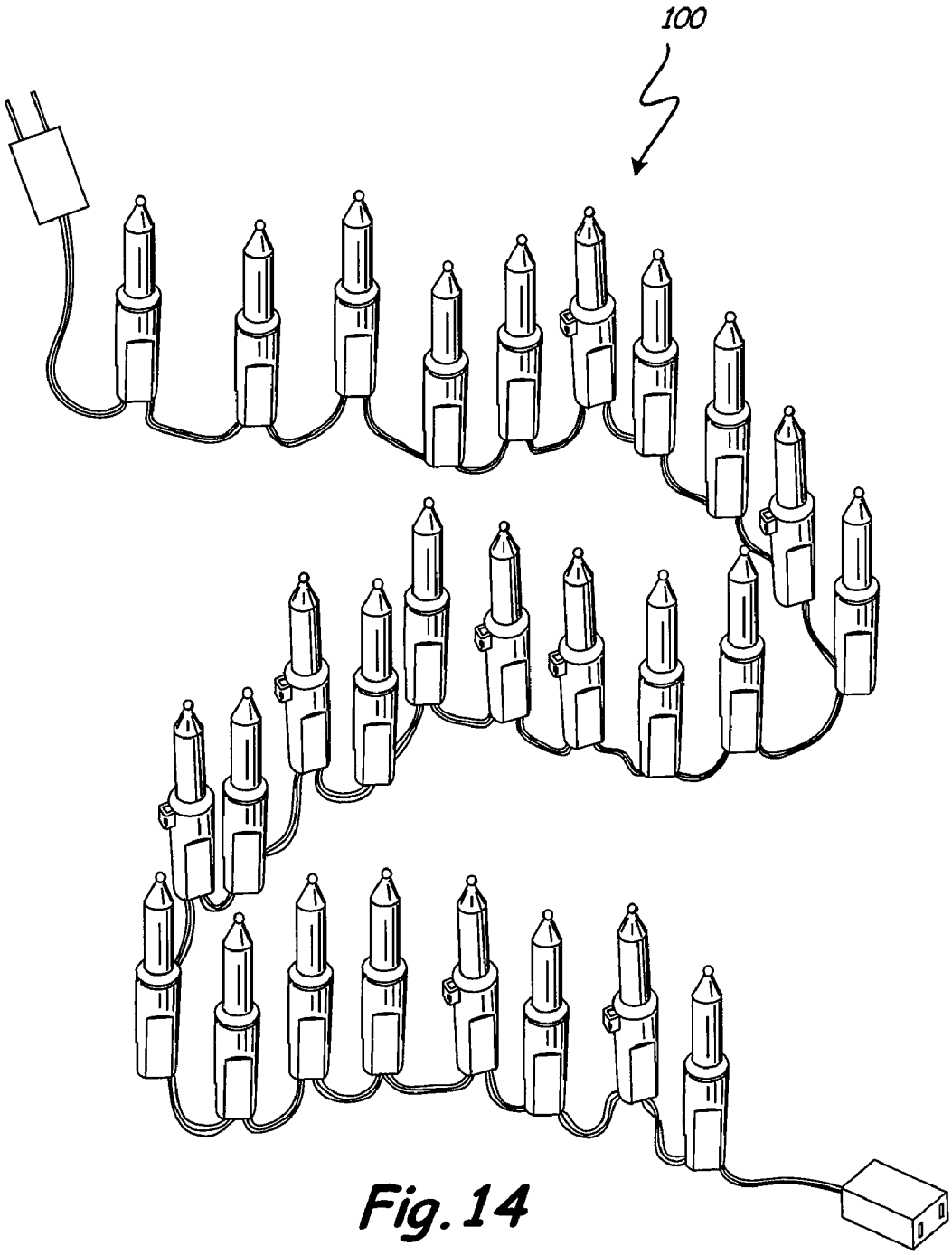
FIG. 14 illustrates a schematic view of one embodiment of a twinkle light set having a plurality of twinkle light bulb apparatuses and a plurality of steady burning light bulb apparatuses, generally in accordance with the principles of the present invention.

In FIG. 14, a twinkle light bulb set 100 generally in accordance with the principles of the present invention includes: a plurality of twinkle light bulb apparatuses 102 and a plurality of steady burning light bulb apparatuses 104.

FIGS. 1-8 illustrate one embodiment of the twinkle light bulb apparatus 102, and FIGS. 9-13 illustrate another embodiment of the twinkle light bulb apparatus 102'.

In FIGS. 1-8, each twinkle light bulb apparatus 102 includes a twinkle light bulb socket 106 with a twinkle light bulb 108 securely retained therein, and a twinkle bulb socket holder 110. The twinkle light bulb socket 106 is removably retained in and electrically coupled with the twinkle light bulb socket holder 110.

The twinkle light bulb socket holder 110 includes a member 112 with a keyway clearance 114 for receiving a projected member 116 disposed on an outside wall of the twinkle light bulb socket 106. A replacement twinkle light bulb socket 118 (see FIG. 3) or a replacement steady burning light bulb socket 120 (see FIG. 6) can be retained within and electrically coupled to the twinkle light bulb socket holder 110.

Further shown in FIGS. 1-8, each steady burning light bulb apparatus 104 includes a steady burning light bulb socket 122 with a steady light bulb 124 securely retained therein, and a steady burning bulb socket holder 126. The steady burning light bulb socket 122 is removably retained in and electrically coupled with the steady light bulb socket holder 126. Only the replacement steady burning light bulb socket 120 can be retained within and electrically coupled to the steady burning light bulb socket holder 126. A replacement twinkle light bulb socket 118 cannot be electrically coupled to the steady burning light bulb socket holder 126 (see FIGS. 5 and 7). The projected member 116 disposed on the outside wall of the replacement twinkle light bulb socket 118 prevents the replacement twinkle light bulb socket 118 from being fully inserted into, retained within, and electrically coupled to, the steady burning light bulb socket holder 126.

The projected member 116 disposed on the outside wall of the replacement twinkle light bulb socket 118 is a male member, and the twinkle light bulb socket holder 110 includes a female member 112 having the keyway clearance 114 for receiving the male member 116.

FIGS. 9-13 illustrate an alternative embodiment of the twinkle light bulb apparatus 102'. Each twinkle light bulb apparatus 102' includes a twinkle light bulb socket 106' with a twinkle light bulb 108' securely retained therein and a twinkle bulb socket holder 110'. The twinkle light bulb socket 106' is removably retained in and electrically coupled with the twinkle light bulb socket holder 110'.

The twinkle light bulb socket holder 110' includes a member 112' with a keyway clearance 114' for receiving a projected member 116' disposed on an outside wall of the twinkle light bulb socket 106'. A replacement twinkle light bulb socket 118' or a replacement steady burning light bulb socket 120' can be retained within and electrically coupled to the twinkle light bulb socket holder 110'.

Figure 1:
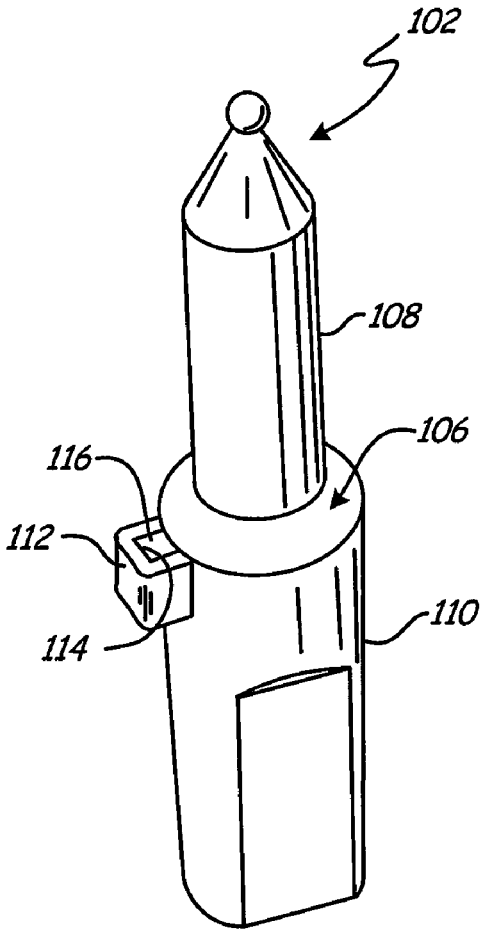
FIG. 1 illustrates a perspective view of one embodiment of a twinkle light bulb apparatus having a twinkle light bulb socket received in a twinkle light bulb socket holder, generally in accordance with the principles of the present invention.
Figure 2:
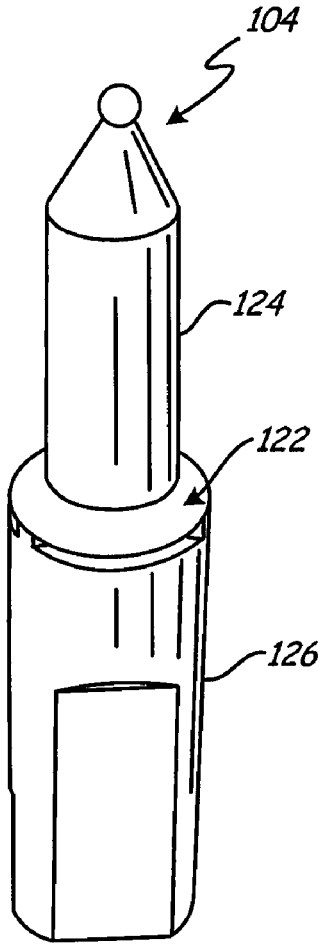
FIG. 2 illustrates a perspective view of one embodiment of a steady burning light bulb apparatus having a steady burning light bulb socket received in a steady burning light bulb socket holder, generally in accordance with the principles of the present invention.
Figure 3:
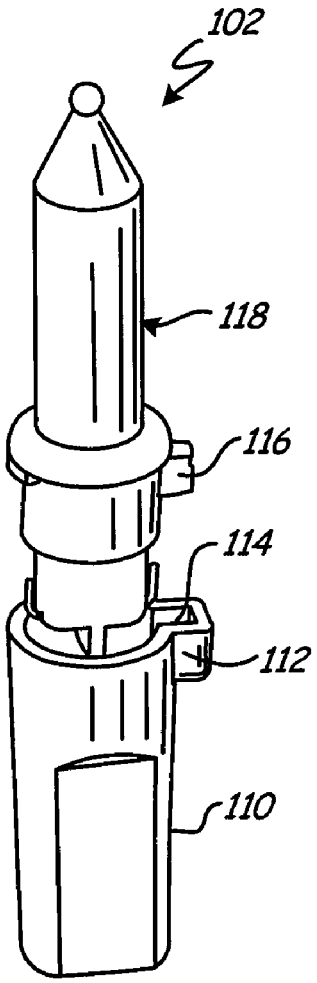
FIG. 3 illustrates a partially exploded view of one embodiment of the twinkle light bulb apparatus of FIG. 1, having the twinkle light bulb socket removed from the twinkle light bulb socket holder.
Figure 4:
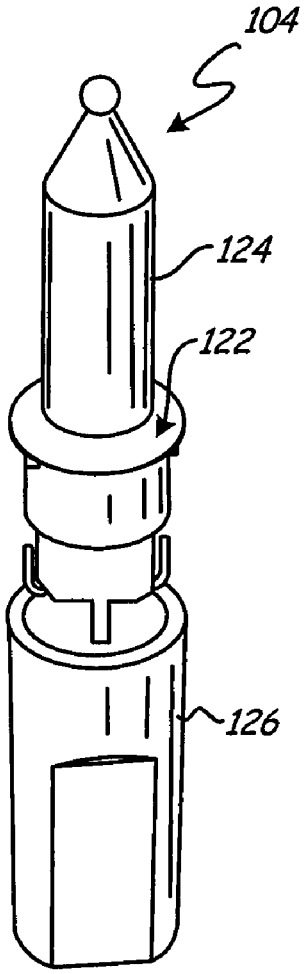
FIG. 4 illustrates a partially exploded view of one embodiment of the steady burning light bulb apparatus of FIG. 2, having the steady light bulb socket removed from the steady light bulb socket holder.
Figure 5:
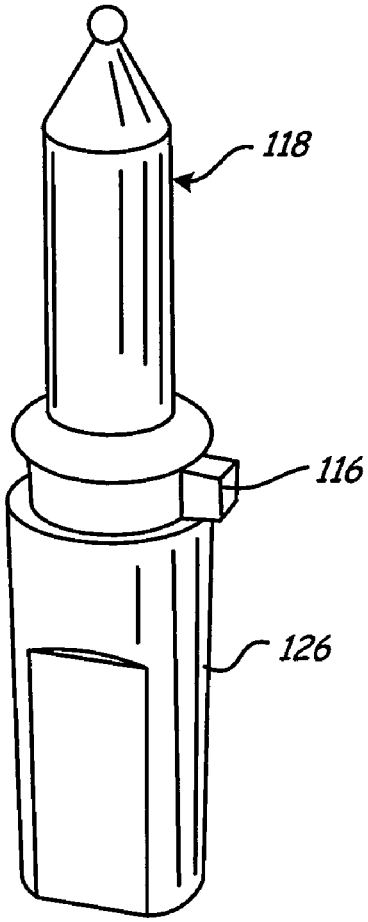
FIG. 5 illustrates a perspective view of a replacement twinkle light bulb socket stopped from being fully inserted into, retained therein, and electrically coupled to, the steady burning light bulb socket holder.
Figure 6:
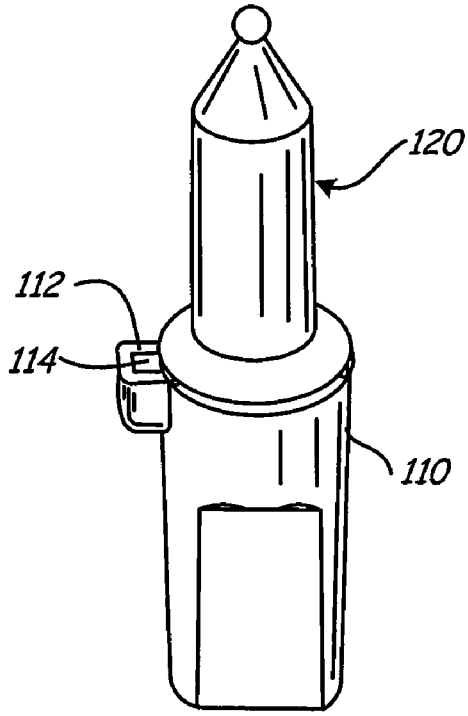
FIG. 6 illustrates a perspective view of a replacement steady burning light bulb socket being fully inserted into, retained therein, and electrically coupled to, the twinkle light bulb socket holder.
Figure 7:
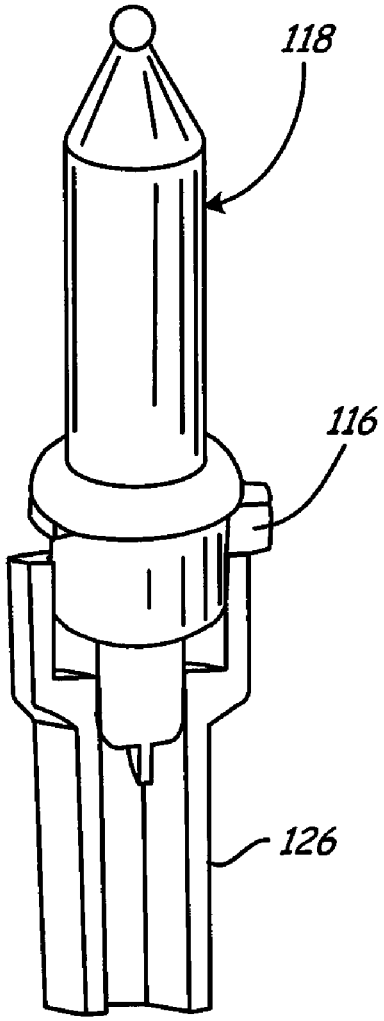
FIG. 7 illustrates a partially cut-away view of the replacement twinkle light bulb socket stopped from being fully inserted into, retained therein, and electrically coupled to, the steady burning light bulb socket holder, as shown in FIG. 5.
Figure 8:
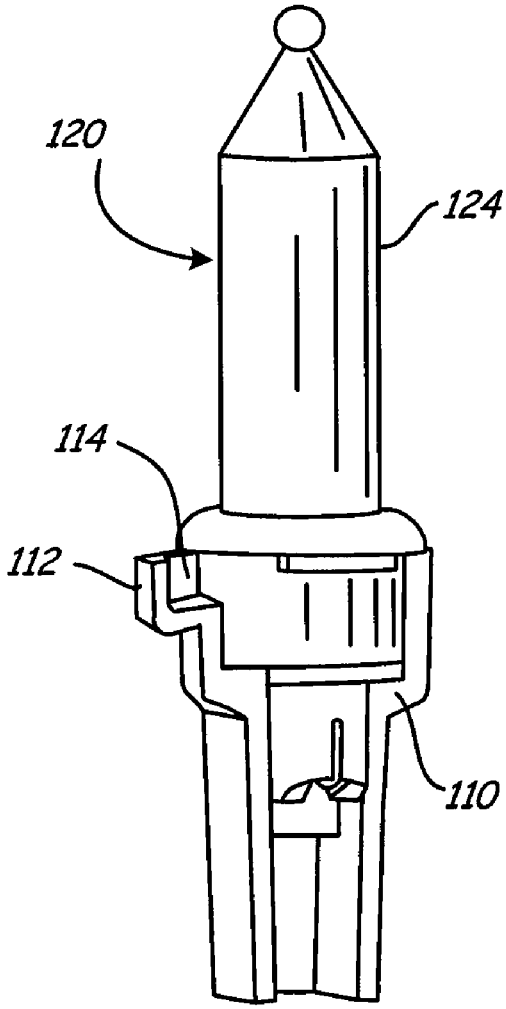
FIG. 8 illustrates a partially cut-away view of the replacement steady burning light bulb socket being fully inserted into, retained therein, and electrically coupled to, the twinkle light bulb socket holder, as shown in FIG. 6.
Figure 9:
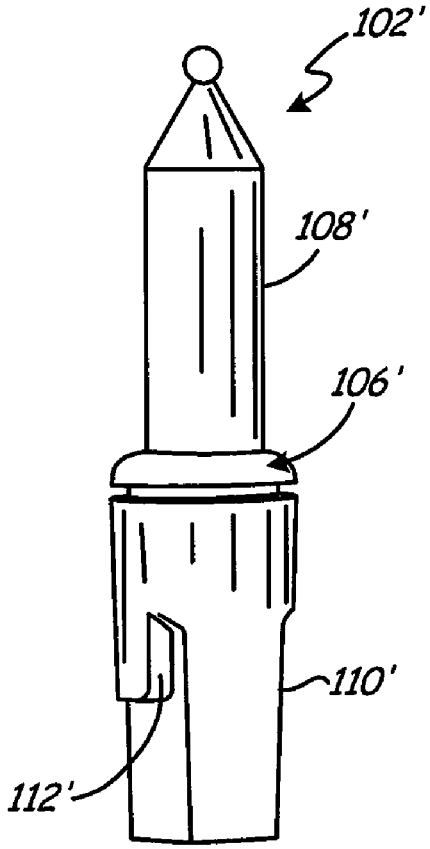
FIG. 9 illustrates a perspective view of an alternative embodiment of a twinkle light bulb apparatus having a twinkle light bulb socket received in a twinkle light bulb socket holder, generally in accordance with the principles of the present invention.
Figure 10:
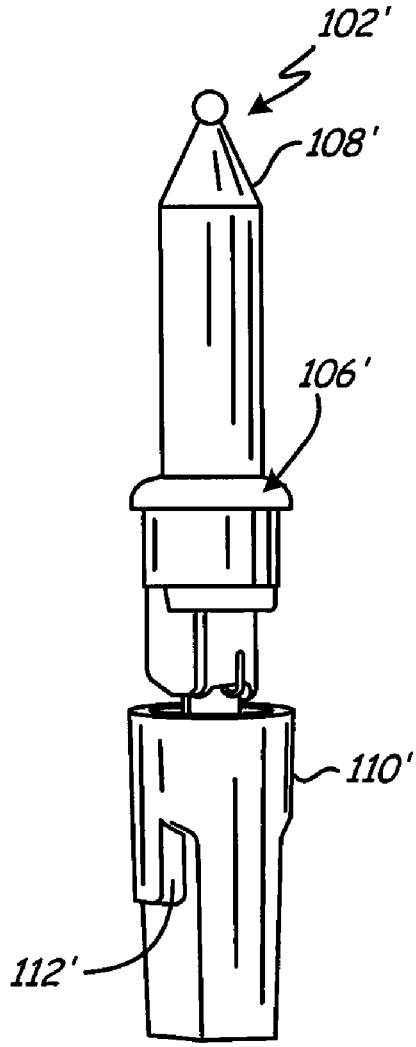
FIG. 10 illustrates a partially exploded view of the alternative embodiment of the twinkle light bulb apparatus of FIG. 9, having the twinkle light bulb socket removed from the twinkle light bulb socket holder.
Figure 11:
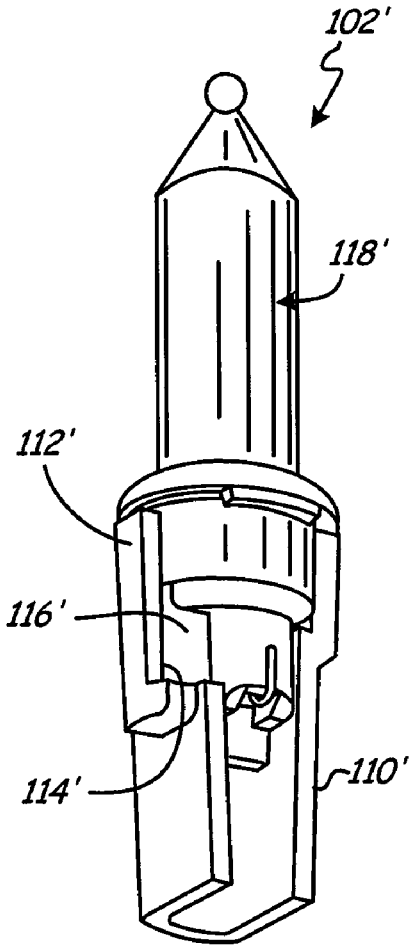
FIG. 11 illustrates a partially cut-away view of the replacement twinkle light bulb socket being fully inserted into, retained therein, and electrically coupled to, the twinkle light bulb socket holder, as shown in FIG. 9.
Figure 12:
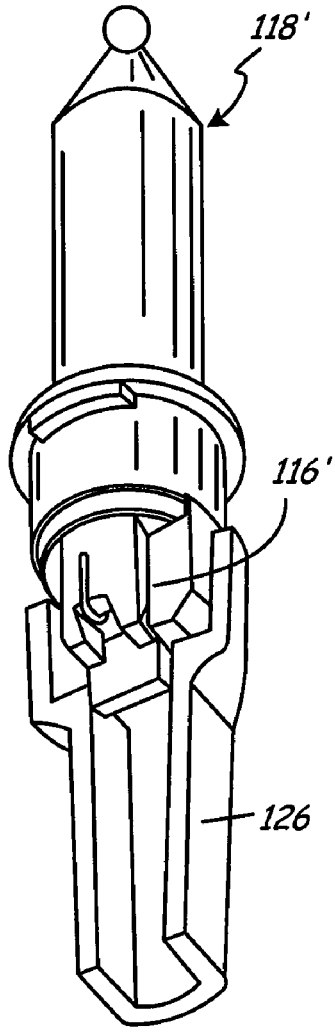
FIG. 12 illustrates a partially cut-away view of the replacement twinkle light bulb socket being stopped from being fully inserted into, retained therein, and electrically coupled to, the steady burning light bulb socket holder.

The projected member 116' disposed on the outside wall of the replacement twinkle light bulb socket 118' is a male member, and the twinkle light bulb socket holder 110' includes the keyway clearance 114' formed between the inside wall of the member 112' and the outside wall of the twinkle light bulb socket 118' for retaining the male member 116' disposed on the outside wall of the replacement twinkle light bulb socket 118'. The steady light bulb socket holder 122 does not include a keyway clearance so that the replacement twinkle light bulb socket 118' with the male member 116' is stopped from being inserted into, retained therein, and electrically coupled to the steady light bulb socket holder 126, as shown in FIG. 12.

Figure 13:
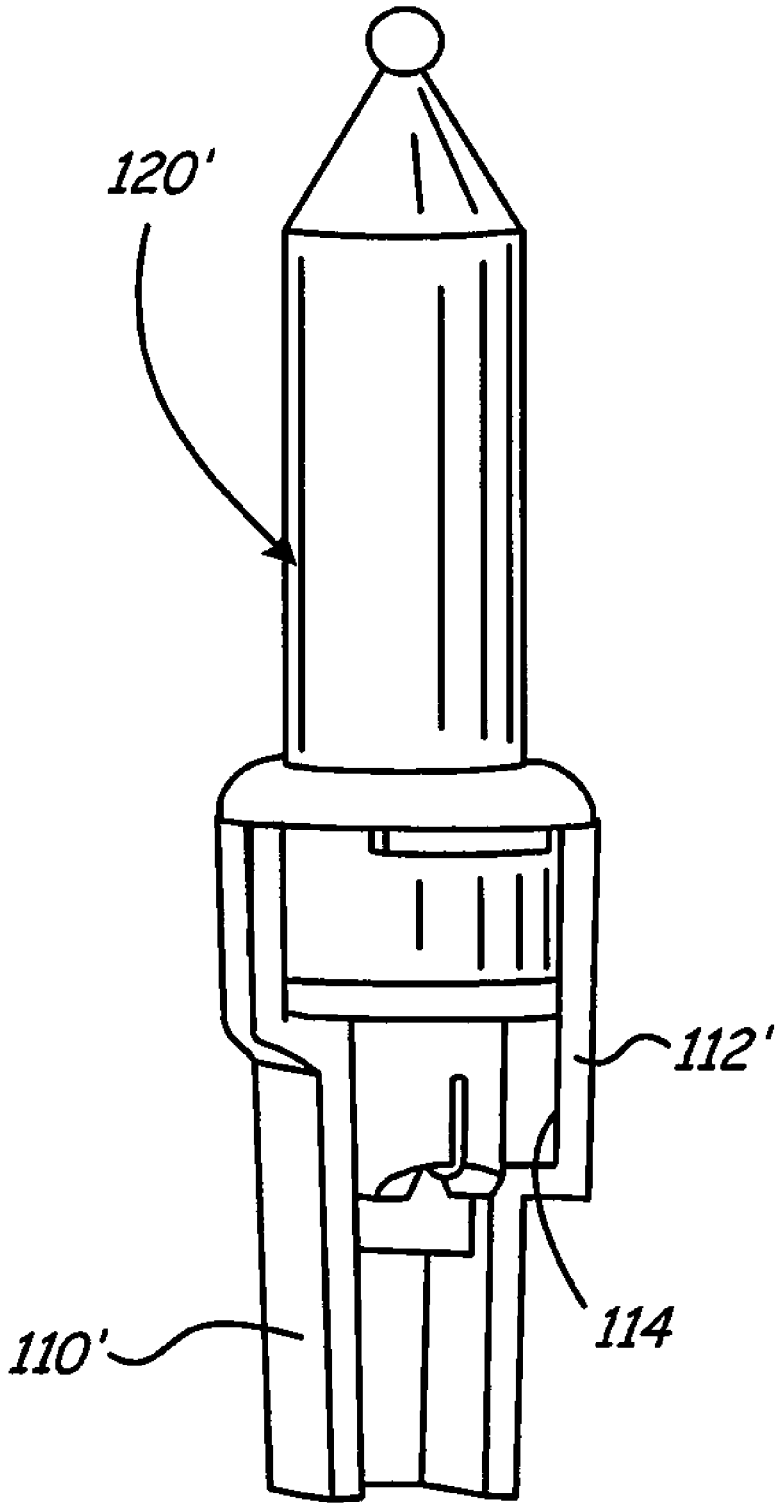
FIG. 13 illustrates a partially cut-away view of the replacement steady burning light bulb socket being fully inserted into, retained therein, and electrically coupled to, the twinkle light bulb socket holder.

As shown in FIG. 13, the replacement steady burning light bulb socket 120' being fully inserted into, retained therein, and electrically coupled to, the twinkle light bulb socket holder 110'. Accordingly, a burned-out twinkle light bulb socket can be replaced by either another twinkle light bulb 118' or a replacement steady burning light bulb socket 120' if a user chooses to do so, thereby allowing a user to replace a twinkle light bulb socket with a steady burning light bulb socket for whatever reasons, e.g. when a user has no replacement twinkle light bulb socket left but still wants to maintain a decorative lighting condition by using extra replacement steady burning light bulbs.

What is claimed is:

1. A twinkle light bulb set, comprising:

a plurality of twinkle light bulb apparatuses, each twinkle light bulb apparatus having a twinkle light bulb socket and a twinkle light socket holder, the twinkle light bulb socket being removably retained in and electrically coupled with the twinkle light bulb socket holder;

a plurality of steady burning light bulb apparatuses, each steady burning light bulb apparatus having a steady burning light bulb socket and a steady burning light socket holder, the steady burning light bulb socket being removably retained in and electrically coupled with the steady burning light bulb socket holder;

the plurality of twinkle light bulb apparatuses being electrically connected to the plurality of steady burning light bulb apparatuses;

the twinkle light bulb socket including twinkle light bulb socket means for being not only replaceable by a replacement twinkle light bulb socket but also replaceable by a replacement steady burning light bulb socket; and the steady burning light bulb socket being only replaceable by a replacement steady burning light bulb socket and not being replaceable by a replacement twinkle light bulb socket.

2. The twinkle light bulb set of claim 1, wherein the twinkle light bulb apparatus further comprises a twinkle light bulb securely retained in the twinkle light bulb socket.

3. The twinkle light bulb set of claim 2, wherein the twinkle light bulb socket means of the twinkle light bulb socket holder comprises a keyway clearance for receiving a projected member disposed on an outside wall of the twinkle light bulb socket.

4. The twinkle light bulb set of claim 3, wherein the projected member disposed on the outside wall of the replacement twinkle light bulb socket prevents a replacement twinkle light bulb socket from being fully inserted into, retained within, and electrically coupled to, the steady burning light bulb socket holder.

5. The twinkle light bulb set of claim 4, wherein the projected member disposed on the outside wall of the replacement twinkle light bulb socket is a male member, and the twinkle light bulb socket holder includes a female member having the keyway clearance for receiving the male member.

6. The twinkle light bulb set of claim 4, wherein the projected member disposed on the outside wall of the replacement twinkle light bulb socket is a male member, and the twinkle light bulb socket holder includes the keyway clearance formed between an inside wall of the twinkle light bulb socket holder and the outside wall of the twinkle light bulb socket.

* * * * *